United States Patent [19]

Hamano et al.

[11] Patent Number: 4,784,504

[45] Date of Patent: Nov. 15, 1988

[54] MULTI-FUNCTION PRINTER

[75] Inventors: Tsutomu Hamano, Odawara; Kunio Numata, Fujisawa, both of Japan

[73] Assignee: NCR Corporation, Dayton, Ohio

[21] Appl. No.: 79,852

[22] Filed: Jul. 30, 1987

[30] Foreign Application Priority Data

Aug. 29, 1986 [JP] Japan ..... 61-201900

[51] Int. Cl.[4] ..... B41S 15/04

[52] U.S. Cl. ..... 400/605; 400/599; 400/600.1; 400/636

[58] Field of Search ..... 400/605, 599, 600.1, 400/607, 607.2, 608.1, 608.2, 636

[56] References Cited

U.S. PATENT DOCUMENTS 4,173,420 11/1979 Okabe ..... 400/608.1 X
4,439,051 3/1984 Lawter ..... 400/605
4,606,663 8/1986 Christoph et al. ..... 400/636 X

FOREIGN PATENT DOCUMENTS 123310 4/1984 European Pat. Off. .
44379 3/1985 Japan ..... 400/607
283580 12/1986 Japan ..... 400/607

*Primary Examiner*—Edgar S. Burr
*Assistant Examiner*—Moshe I. Cohen
*Attorney, Agent, or Firm*—Wilbert Hawk, Jr.; Albert L. Sessler, Jr.

[57] ABSTRACT

A multi-function printer can print on two different types of record media, one of which types of record media is continuous, such as may be used for printing receipts, and is stored within the printer, and a second of which types of record media is discontinuous, may be of varying thickness, and is introduced from the exterior of the printer. A reversible motor and associated transmission mechanism provide means for driving the two types of record media, and a pivotally mounted solenoid-driven platen arm provides for selective engagement of driving means in the printer and for altering the gap between the printhead and the platen of the printer in accordance with the thickness of the record media to be printed upon.

7 Claims, 1 Drawing Sheet

MULTI-FUNCTION PRINTER

BACKGROUND OF THE INVENTION

The present invention relates to a printer which has only one print station, but which is capable of printing on two different types of record media, one being a continuous type of record medium, such as that used for printing a receipt, which is stored in the printer, and the other being a record medium such as a slip which is introduced to the printer from outside.

An example of a one-station two-function printer is disclosed in Japanese Published Patent Specification No. 42474/81 in which a receipt feed path is changed from its original position in connection with the switching of the printing modes to withdraw a receipt tip from a passage of a print station thereby to permit the insertion and printing of another record medium.

Also, Japanese Laid Open Patent Specification No. 14978/84 discloses a printer of the type in which a paper not to be printed thereon is taken up until it reaches a passage positioned on the outside of a print station to permit the insertion and passing of a paper to be printed and in which feed rollers respectively adapted to feed two types of paper can be selectively driven by one motor.

In the above-mentioned conventional printers, switching means to change the passage for a record medium itself or to switch rollers to be connected with a carrier motor is needed in order to perform printing on two different record media at one station and hence the structures thereof are relatively complicated.

In addition, since a slip is frequently thicker than a receipt, it is desirable to adjust a gap between the print head and the platen in proportion to the thickness of the slip. Accordingly, the prior art needs a mechanism for the gap adjustment in addition to the above mentioned means. As has been described above, in the conventional one-station two-function printer, various switching means are needed in order to switch various elements of the printer in conformity with various record media, so that the general structure of such a printer is relatively complicated.

SUMMARY OF THE INVENTION

The present invention has been developed in view of the above-mentioned drawbacks associated with conventional printers.

In accordance with one embodiment of the invention, printing apparatus which is capable of printing in a first mode of operation on a first kind of record media which is provided from a supply contained within the printing apparatus, said supply being continuous in configuration, said printing apparatus also being capable of printing in a second mode of operation on a second kind of record media which is introduced into the printing apparatus from its exterior, comprises: a printhead; a platen; a platen arm pivotally mounted in the printing apparatus and having the platen secured thereto in operative relation to said printhead; operating means for shifting said platen arm between first and second positions; feed roller means for feeding both first and second kinds of record media; shift roller means mounted in the printer apparatus for withdrawing or feeding said first kind of record media; reversible motor means mounted on said platen arm for driving said feed roller means and said shift roller means at selected times; first transmitting means adapted to transmit the motion of said motor means to said feed roller means; and second transmitting means adapted to transmit the motion of said motor means to said shift roller means when said platen arm is in said first position, whereby said first kind of record media can be withdrawn from a position adjacent said printhead and a space is opened between said printhead, and said platen for introduction of said second kind of record media when said platen arm is in said first position, and whereby said first or said second kind of record media can be fed out of said printing apparatus when said platen arm is in said second position.

Accordingly, an object of the present invention is to provide a printer in which one operating means permits the withdrawal of unneeded record medium, the changing of the coupling between a driving motor and power transmitting means, and the adjustment of the gap between the print head and the platen in proportion to the thickness of the record medium.

DETAILED DESCRIPTION

Figure 1:
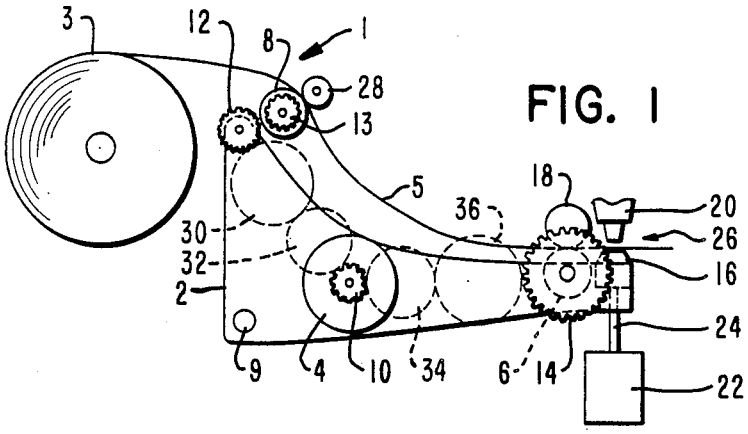
FIG. 1 is a side view showing a portion of a printer in accordance with one embodiment of the present invention in an operating mode in which a receipt is printed.
Figure 2:
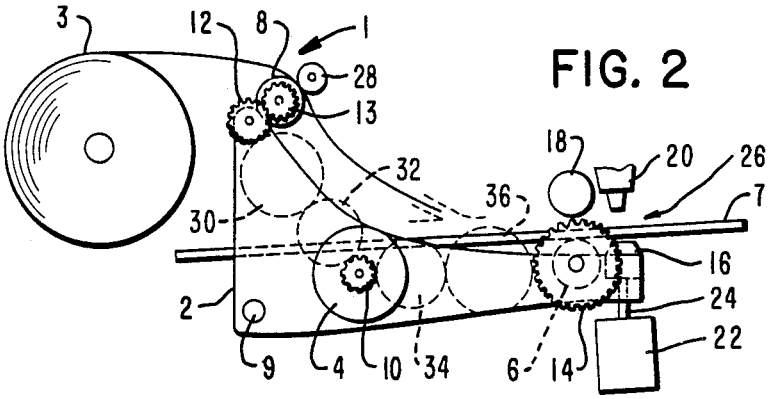
FIG. 2 is a side view similar to that of FIG. 1, showing the printer when its platen arm has been rotated in a clockwise direction, in a second mode of operation of the printer, in which a slip is being printed.

As shown in FIGS. 1 and 2, a printer 1 includes a printhead 20. A platen 16 is located in cooperative relation to the printhead 20 and is fixed to a first end of a movable platen arm 2 which is pivotally mounted on a shaft 9 in the printer. Also mounted on the platen arm 2 are a reversible motor 4 having a gear 10 driven by said motor, a second gear 12 rotatably mounted at a second end of the platen arm 2, and a third gear 14 rotatably mounted near the first end of the platen arm 2. As shown in FIGS. 1 and 2, motion is transmitted to the gears 12 and 14 from the gear 10 by additional gears 30, 32, 34, 36 shown in phantom lines, though other transmission means such as pulleys and belts, or cooperating rollers, could be employed, if desired. A feed roller 6 is fixed to the same shaft as the gear 14 and rotates therewith. A pusher roller 18 mounted in the printer framework opposite the feed roller 6 cooperates with the roller 6 for feeding of record media when the platen arm 2 is in the position shown in FIG. 1. Movement of the platen arm 2 from the position in which it is shown in FIG. 2 to the position in which it is shown in FIG. 1 is accomplished by a solenoid 22 which is coupled to the platen arm 2 by a plunger 24.

When the platen arm 2 is in the position in which it is shown in FIG. 2, the gear 12 on the platen arm 2 cooperates with a gear 13 journalled in the framework of the printer 1. A shift roller 8 is fixed on the same shaft as the gear 13 and rotates therewith. A roller 28 is journalled in the framework of the printer 1 and cooperates with the shift roller 8 to feed a continuous record medium 5 therebetween to or from a supply roll 3 contained within the printer. The record medium 5 may be printed upon by the printhead 20 and used for the issuance of a receipt to a customer in connection with a business transaction.

As will subsequently be described in greater detail, when the platen arm 2 is in the position shown in FIG.

2, the record medium 5 may be withdrawn from a position between the printhead 20 and the platen 16 by reverse rotation of the motor 4, and a slip 7, which may comprise a plurality of sheets, may be introduced from the exterior of the printer into a position between the platen 16 and the printhead 20 for printing thereon.

In the receipt printing mode, the receipt record medium 5 is led out to the opening 26 and the solenoid 22 is energized to push the plunger 24 upwardly and thereby rotate the platen arm 2, to which it is coupled, in a counterclockwise direction, from the position in which it is shown in FIG. 2 to the position in which it is shown in FIG. 1. Accordingly, the receipt record medium 5 is gripped between the feed roller 6 and the pusher roller 18 so that the receipt record medium 5 can be freely fed by operating the motor 4 in accordance with the requirements of the printing operation which includes the printhead 20.

The rotational motion of the motor 14 is also transmitted to the gear 12 simultaneously with its transmission to the gear 14, but produces no further effect at this time since the gear 12 is not operatively engaged with the gear 13.

Now let it be assumed that the printer 1 is changed in operation from the receipt printing mode to the slip printing mode. The solenoid 22 is deenergized by a mode switch signal and the platen arm 2 rotates clockwise on the shaft 9 by its own weight, from the position shown in FIG. 1 to the position shown in FIG. 2. Upon the clockwise rotation of the platen arm 2, the gear 12 engages with the gear 13, causing shift roller 8 to rotate in the rotating direction of the motor 4. The motor is caused to rotate in a direction to cause the cooperating shift roller 8 and roller 28 to take up the receipt record medium 5 on the roll 3. When the gear 12 first engages with the gear 13, the motor 4 may be rotated by a minute amount in order to enable the gears 12 and 13 to engage each other smoothly. The motor 4 stops after the receipt 5 is taken up by a predetermined amount.

Thereafter, the slip record medium 7 is inserted into the opening 26, as shown in FIG. 2, for performing of printing thereon. Before the printing operation is performed on the slip record medium 7, the solenoid 22 is energized to rotate the platen arm 2 in a counterclockwise direction. This causes the slip record medium 7 to be gripped and held between the feed roller 6 and the pusher roller 18 so that a gap in proportion to the thickness of the slip record medium 7 is obtained between the printhead 20 and the platen 16.

After completion of printing on the slip record medium 7, and when it is desired to change the receipt printing mode, the solenoid 22 is deenergized, as in the case of changing to the slip printing mode, to engage the gear 12 with the gear 13.

The motor 4 is then operated in a direction of rotation to cause the cooperating shift roller 8 and roller 28 to feed the receipt record medium 5 toward the print station. When the receipt record medium 5 reaches the print station, the motor 4 is stopped and waits a command for the printer to print out on the receipt record medium 5. When a printing signal is received the solenoid 22 is energized, as in the case of printing on the slip record medium 7, to rotate the platen arm 2 in a counterclockwise direction for a printing operation on the receipt record medium 5.

In the illustrated embodiment, the weight of the platen arm 2 is utilized to obtain its clockwise rotation when the solenoid 22 is deenergized. Instead, if desired, elastic members such as springs or the like could be used.

As has been described above, in accordance with the present invention, a printer can provide the functions to perform the withdrawal and feeding of the record media, the switching of the roller driving means in accordance with the changing of a mode of printing, and the adjustment of the gap between the platen and the printhead in proportion to the thickness of the record medium by providing only a single operating means, as re-resented by the solenoid 22 and the platen arm 2 driven by the solenoid 22 in the illustrated embodiment.

What is claimed is:

1. Printing apparatus which is capable of printing in a first mode of operation on a first kind of record media which is provided from a supply contained within the printing apparatus, said supply being continuous in configuration, said printing apparatus also being capable of printing in a second mode of operation on a second kind of record media which is introduced into the printing apparatus from its exterior, comprising:

a printhead;

a platen;

a platen arm pivotally mounted in the printing apparatus and having the platen secured thereto in operative relation to said printhead;

operating means for shifting said platen arm between first and second positions;

feed roller means for feeding both first and second kinds of record media:

shift roller means mounted in the printer apparatus for withdrawing or feeding said first kind of record media;

reversible motor means mounted on said platen arm for driving said feed roller means and said shift roller means at selected times;

first transmitting means adapted to transmit the motion of said motor means to said feed roller means; and second transmitting means adapted to transmit the motion of said motor means to said shift roller means when said platen arm is in said first position, whereby said first kind of record media can be withdrawn from a position said printhead and a space is opened between said printhead and said platen for introduction of said second kind of record media when said platen arm is in said first position, and whereby said first or said second kind type of record media can be fed out of said printing apparatus when said platen arm is in said second position.

2. The printing apparatus of claim 1 in which said operating means is a solenoid.

3. The printing apparatus of claim 1 in which said feed roller means comprises a feed roller mounted on the platen arm and driven by the motor means, and a pusher roller mounted in the printing apparatus to be in cooperative record media driving relation with said feed roller when said platen arm is in said second position.

4. The printing apparatus of claim 3 in which the distance between said feed roller and said pusher roller when record media is positioned therebetween in said second position of said platen arm provides a gap between the printhead and the platen which is proportional to the thickness of the record media.

5. The printing apparatus of claim 1 in which said shift roller means comprises first and second rollers mounted in said printing apparatus, and in which said second transmitting means includes a first gear on said first roller and a cooperating second gear on the platen arm to drive said first roller when said platen arm is in said first position.

6. The printing apparatus of claim 5 in which said gear on said platen arm is mounted adjacent to one end of said platen arm.

7. The printing apparatus of claim 6 in which the motor means may be operated briefly to facilitate meshing of said first and second gears.

* * * * *

UNITED STATES PATENT AND TRADEMARK OFFICE

CERTIFICATE OF CORRECTION

PATENT NO. : 4,784,504

DATED : November 15, 1988

INVENTOR(S) : Tsutomu Hamano et al.

It is certified that error appears in the above-identified patent and that said Letters Patent is hereby corrected as shown below:

Column 4, line 44, after the word "position" insert --adjacent--.

Column 5, line 49, delete the word "type".

Signed and Sealed this

Fourth Day of April, 1989

*Attest:*

*Attesting Officer*

DONALD J. QUIGG

*Commissioner of Patents and Trademarks*